US007600288B1

(12) United States Patent
Givonetti

(10) Patent No.: US 7,600,288 B1
(45) Date of Patent: Oct. 13, 2009

(54) CONFORMING TOOTHBRUSH HEAD WITH PRESSURE EQUALIZER

(76) Inventor: Raymond R. Givonetti, 12622 Woodcove La., Knoxville, TN (US) 37922

( * ) Notice: Subject to any disclaimer, the term of this patent is extended or adjusted under 35 U.S.C. 154(b) by 0 days.

(21) Appl. No.: 12/131,058

(22) Filed: May 31, 2008

(51) Int. Cl.
*A46B 9/04* (2006.01)

(52) U.S. Cl. ..... 15/167.1; 15/201

(58) Field of Classification Search ..... 15/167.1, 15/201
See application file for complete search history.

(56) References Cited

U.S. PATENT DOCUMENTS

| | | | | | |
|---|---|---|---|---|---|
| 2,882,544 | A | * | 4/1959 | Hadidian | 15/167.1 |
| 2,935,755 | A | * | 5/1960 | Leira et al. | 15/167.1 |
| 4,240,452 | A | * | 12/1980 | Jean | 15/167.1 |
| 4,633,542 | A | * | 1/1987 | Taravel | 15/167.1 |
| 4,694,844 | A | * | 9/1987 | Berl et al. | 15/167.1 |

FOREIGN PATENT DOCUMENTS

| | | | |
|---|---|---|---|
| DE | 4122524 | * | 2/1992 |
| JP | 7-265127 | * | 10/1995 |
| JP | 10-5041 | * | 1/1998 |
| JP | 2001-25411 | * | 1/2001 |
| WO | 03/001943 | * | 1/2003 |

* cited by examiner

*Primary Examiner*—Mark Spisich

(57) ABSTRACT

The toothbrush head of the present invention is designed to conform to teeth surfaces by equalizing bristle pressure longitudinally. There is an elastomeric field, populated with bristles, that is allowed to flex within a rigid perimeter frame. The frame is bonded to a rigid top member which is an extension of the toothbrush handle. A bristle pressure equalizing device adjusts the longitudinal shape of the bristles by sensing and equalizing the pressures on the elastomeric field and bristles. This equalization of bristle pressures applies to convex and concave teeth surfaces.

In four embodiments, the bristle pressure equalizing device is a confined mobile substance located in the elastomeric field or in bladders between the top of the elastomeric field and the underside of the top member of the head. Initial bristle pressure pushes the elastomeric field toward the equalizing device which transfers the mobile substance longitudinally to bristle regions of less pressure, thus equalizing bristle pressures.

In another embodiment, the pressure equalizing device is a flat spring bonded to and roughly the size of the elastomeric field. The top member differs from other embodiments in that it has additional transversal ribs the full transversal width of the elastomeric field and are positioned longitudinally such that when initial bristle pressure is applied the spring reacts to equalize bristle pressures.

5 Claims, 3 Drawing Sheets

CONFORMING TOOTHBRUSH HEAD WITH PRESSURE EQUALIZER

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of toothbrushes and more particularly to toothbrush head configurations.

2. Description of the Related Art

Traditionally, the great majority of toothbrushes have fixed bristle heads with many variations on bristle field shapes, bristle lengths, and bristle softness designed to enhance effective tooth cleaning and massaging of gingival tissue. Recently, there have been many head designs which provide some flexibility in the head to help reach more teeth and gingival surfaces. In general, existing flexible head toothbrush designs incorporate elastomer materials or segmented/notched/hinged sections or both to provide head flexibility. In all cases the heads flex as a result of bristle pressure being applied to a particular head region meaning that there is a variation of bristle pressures. For example, if there is bristle pressure applied to one end of the head, there will much less, if any, bristle pressure at the other end of the head. In addition, most existing heads are somewhat effective on anterior convex surfaces with limited effectiveness on interior concave surfaces especially the lower front interior lingual region; which requires a toothbrush that provides a convex surface that is effective when rolled away from the gingival tissue or gum line. Ironically, the lower front interior tooth region is probably the most susceptible to plaque/tartar since this region has the greatest exposure to saliva. Plaque is a sticky film formed by decaying food particles and saliva. Tartar is long-term plaque which hardens into a crusty deposit also called calculus.

It is the object of this invention to provide a pressure equalizing device in the toothbrush head, which enables bristles to conform to interior and anterior teeth surfaces by equalizing bristle pressures longitudinally; a feature not yet available in existing toothbrush art.

Other devices have been developed to overcome these and similar problems associated with . . . Typical of the art are those devices disclosed in the following U.S. Patents:

| U.S. Pat. No. | Inventor(s) | Issue Date |
|---|---|---|
| 4,209,871 | Raymond Ernest<br>Jack Nestor | Jul. 1, 1980 |
| 5,054,154 | Carl Shiffer<br>Berthold Meyer | Oct. 8, 1991 |
| 5,651,158 | Hans Halm | Jun. 29, 1997 |
| 5,758,383 | Douglas J. Hohlbein | Jun. 2, 1998 |
| 5,802,656 | Peter Leonard Lawson<br>Bert Davis Heinzelman<br>Donald Richard Lamond<br>John Moldauer<br>Steven John Raven | Sep. 8, 1998 |
| 5,898,967 | Jian Zhi Wu | May 4, 1999 |

-continued

| U.S. Pat. No. | Inventor(s) | Issue Date |
|---|---|---|
| | Rui Qing Lai | |
| 5,946,758 | Douglas J. Hohlbein<br>Thomas Edward Mintel | Sep. 7, 1999 |
| 5,970,564 | George Richard Inns<br>Stephen John Raven<br>Derek Guy Savill | Oct. 26, 1999 |
| 5,991,958 | Douglas J. Hohlbein | Nov. 30, 1999 |
| 5,991,959 | Stephen John Raven<br>Derek Guy Savill | Nov. 30, 1999 |
| 6,073,299 | Douglas J. Hohlbein | Jun. 13, 2000 |
| 6,088,870 | Douglas J. Hohlbein | Jul. 18, 2000 |
| 6,178,582 | Hans Halm | Jan. 30, 2001 |
| 6,185,779 | Hans Kramer | Feb. 13, 2001 |
| 6,219,874 | Maria van Gelder<br>Kristie Jane Morgan | Apr. 24, 2001 |
| 6,314,605 | Sanjay Amratlal Solanki<br>Simon Phillip Shenton | Nov. 13, 2001 |
| 6,314,606 | Douglas J. Hohlbein | Nov. 13, 2001 |
| 6,408,476 | David Victor Cann | Jun. 25, 2002 |
| 6,442,787 | Douglas J. Hohlbein | Sep. 3, 2002 |
| 6,675,428 | Hans Halm | Jan. 13, 2004 |
| 6,996,870 | Douglas J. Hohlbein | Feb. 14, 2006 |
| 7,275,277 | Robert A. Moskovich<br>Michael C. Rooney | Oct. 2, 2007 |

Of these patents, Ernest and Nester, in the '871 patent discloses a "Toothbrush with Improved Interproximal and Free Gingival Margin Accessibility" which has a head configuration perpendicular to the handle designed to contact gingival tissue on both the maxillary and mandibular teeth using a rotary motion. The handle and head design requires holding the toothbrush on the opposite side of the mouth cavity while cleaning the buccal surfaces; then the bristle stem must be rotated in the handle to clean the lingual surfaces. The other half of the mouth is then similarly brushed holding the handle with the opposite hand. Traditional toothbrushes with bristle fields approximately one inch long and parallel to the handle can contact multiple teeth on straight anterior surfaces. The perpendicular head limits brushing to one or two teeth but because of the narrow vertical bristle field it is more effective addressing the interior lower mouth region.

Schiffer and Meyer in the '154 patent, discloses a toothbrush with an elastic segment between the handle and head to reduce damage to gums and teeth by reducing brushing pressure.

Halm in the '158 patent discloses a toothbrush head in the form of one or more segments which are flexibly and/or resiliently linked to each other. The grooves between the linked segments are filled with an elastomeric material. The first embodiment is a head with transverse grooves and one or more longitudinal grooves; this embodiment permits a force to be applied to the distal end of the head and which deflects the head in a convex manner. The second embodiment the head is surrounded by a frame which is bridged to the tuft field at both ends of the head which takes on a concave shape when force is applied to the center of the head. The third embodiment also provides a limited concave shape using a spine network connected to the surrounding frame.

Hohlbein, in the '383 patent, discloses a "Contouring Toothbrush Head" where the head is made up of two rigid sections coupled by a flexible joint. The two sections are slightly angled to each other forming a crude concave bristle surface. The head contacts some convex surfaces and flexes to contact straight surfaces. The angled front section of the head is pointed toward the front lingual mouth region to access the lower interior teeth.

Dawson, Heinzelman, Lamond, Moldauert and Raven in the '656 patent discloses a "Toothbrush with Flexibly Mounted Bristles" designed to reduce excessive permanent bristle splaying by providing multiple configurations of perimeter or side member bristle tufts that are capable of a toggling movement.

Wu and Lai in the '967 patent discloses a "Flexible Toothbrush" incorporates a flexible leaf spring embedded into the toothbrush neck to provide flexibility while brushing and reducing the occurrence of cracked or broken handles.

Hohlbein and Mintel in the '758 patent, "Toothbrush Having Contouring Multi-Component Head with Peel Resistant Joint and Limited Flexibility", discloses a refinement to the '383 patent where the elastomer filled grooves are not unduly subject to stress forces that will cause peeling of the elastomer.

Inns, Raven and Savill in the '564 patent discloses a toothbrush with bristles flexibly mounted in a material which is compatible with the material of the bristles and the material of the head. The patent also discloses a bristle and head configuration that can repeatable and resiliently splay in a multidirectional manner.

Hohlbein, in the '958 patent, discloses a "Contouring Toothbrush Head" where the head is made up of two rigid sections coupled by a flexible joint. The two sections are slightly angled to each other forming a rough concave bristle surface. The head contacts some convex surfaces and flexes to contact straight surfaces. The angled front section of the head is pointed toward the front lingual mouth region to access the lower interior teeth.

Raven and Savill '959 patent discloses a "Toothbrush with Flexibly Mounted Bristles" designed to reduce excessive permanent bristle splaying by providing multiple configurations of perimeter or side member bristle tufts that are capable of a toggling movement.

Hohlbein, in the '299 patent, discloses a "Contouring Toothbrush Head" where the head is made up of two rigid sections coupled by a flexible joint. The two sections are slightly angled to each other forming a rough concave bristle surface. The head contacts some convex surfaces and flexes to contact straight surfaces. The angled front section of the head is pointed toward the front lingual mouth region to access the lower interior teeth.

Hohlbein, in the U.S. Pat. No. 6,088,870, discloses a "Toothbrush Head With Flexibly Mounted Bristles" features a flexibly resilient lattice network where bristle tufts are mounted at the lattice nodes; the network is supported by a rigid periphery. The resultant configuration is intended to conform to various arcuate surfaces of the teeth.

Halm in the '582 patent discloses multiple embodiments of a toothbrush with flexibility at the head tip, designed to improve the ability of a toothbrush to clean surfaces of the teeth which face the back of the mouth. In a preferred embodiment of the toothbrush of this invention the bristle face of the tip region forms an angle of less than 180 degrees with the bristle face of the base region, suitably 150-170 degrees.

Kramer in the '779 patent discloses a toothbrush head in the form of one or more segments which are flexibly linked to each other. The grooves between the linked segments are filled with an elastomeric material. The general embodiment is a head with transverse grooves and one longitudinal groove.

Gelder and Morgan in the '874 patent discloses a toothbrush with transverse grooves on both sides of the head and longitudinal groves on the bristle side of the head. The bristle face is concave with no forces applied and tends to be convex with forces applied especially at the distal end of the head.

Solanki and Shenton in the 605 patent discloses a toothbrush with transverse grooves on one or both sides of the head configured in such a manner such that tuft groups or segments can operate substantially without interference from neighboring groups of tufts.

Hohlbein, in the '606 patent, discloses a "Contouring Toothbrush Head" where the head is made up of two rigid sections coupled by a flexible joint. The two sections are slightly angled to each other forming a rough concave bristle surface. The head contacts some convex surfaces and flexes to contact straight surfaces. The angled front section of the head is pointed toward the front lingual mouth region to access the lower interior teeth.

Cann in the '476 patent discloses a toothbrush comprising of a handle with one or more elastomeric regions, a head with one or more elastomeric filled transverse grooves and one or more elastomer supply channels between the handle elastomeric regions and the transverse grooves permitting elastomer filling from a single injection point.

Hohlbein, in the '787 patent, discloses a "Contouring Toothbrush Head" where the head is made up of two rigid sections coupled by a flexible joint. The two sections are slightly angled to each other forming a rough concave bristle surface. The head contacts some convex surfaces and flexes to contact straight surfaces. The angled front section of the head is pointed toward the front lingual mouth region to access the lower interior teeth.

Halm, in the '428 patent, discloses a "Toothbrush Comprising a Resilient Flex Region". "It is the object of this invention to provide a toothbrush in which the flexibility of the head is concentrated in the tip of the head remote from the handle, so as to improve the ability of the toothbrush to clean surfaces of the teeth which face the back of the mouth".

Hohlbein in the U.S. Pat. No. 6,996,870 discloses a "Contouring Toothbrush Head" where the head is made up of two rigid sections coupled by a flexible joint. The two sections are slightly angled to each other forming a rough concave bristle surface. The head contacts some convex surfaces and flexes to contact straight surfaces. The angled front section of the head is pointed toward the front lingual mouth region to access the lower interior teeth. In addition, at least one of the head sections includes a plurality of elastomeric fingers partially defining the side surface of that head section and partially extending from the bottom surface of that head section.

Moskovich and Rooney in the '277 patent discloses "Flexible Toothbrush Head" where the head consists of a flexible tuft field surrounded by a rigid perimeter which enables sonic welding to the toothbrush body. The tuft field flexes with bristle pressure, more easily at the center, and conforms to a convex surface to some degree.

BRIEF SUMMARY OF THE INVENTION

It is the object of this invention to provide a pressure equalizing device in the toothbrush head, which enables bristles to conform to interior and anterior teeth surfaces by equalizing bristle pressures longitudinally.

The toothbrush of this invention consists of a flexible/elastomeric tuft field surrounded by a rigid frame that is attached to rigid head top member which extends to the handle. The void space between the rear side of the elastomeric field and underside of the head top member is filled with a pressure equalizing device that equalizes bristle forces longitudinally forcing the longitudinal shape of the bristles to conform to the surface it contacts. The elastomeric material is extended on all sides of the bristles and bonded/molded to a rigid frame to provide the necessary perimeter flexibility and an easy means for sonic welding to the rigid head top member. There are multiple embodiments that address different configurations of the pressure equalizing device:

The first embodiment, the pressure equalizing device is a liquid, filled bladder that occupies the volume between the rear of the elastomeric field and the underside of the rigid top member. When a force is applied to a bristle region, the liquid displaces to other bristle regions, which equalizes the pressure on the surfaces in contact with the bristles. To increase the longitudinal displacement verses the transversal displacement multiple longitudinal channels are employed in the bladder or multiple bladders are placed side by side longitudinally. The bladders are thin walled, very resilient, elastomeric or rubberized bladders. The liquid is a suitable liquid safe for oral hygiene such as water.

The second embodiment, the pressure equalizing device is a gas, filled bladder that occupies the volume between the rear of the elastomeric field and the underside of the rigid top member. When a force is applied to a bristle region, the gas displaces to other bristle regions, which equalizes the pressure on the surfaces in contact with the bristles. To increase the longitudinal displacement verses the transversal displacement multiple longitudinal channels are employed in the bladder or multiple bladders are placed side by side longitudinally. The bladders are thin walled, very resilient, elastomeric or rubberized bladders. The gas is a suitable gas safe for oral hygiene such as air. The gas is sufficiently compressed to assure close to linear longitudinal displacements.

In the third embodiment, the bladders of the first embodiment are eliminated by extending the elastomeric field to the underside of the top member. The extension of the elastomeric field is molded with longitudinal cavities that are injected 10 with a liquid and sealed prior to sonic welding to the top member. When a force is applied to a bristle region, the liquid displaces to other bristle regions, which equalizes the pressure on the surfaces in contact with the bristles. To increase the longitudinal displacement verses the transversal displacement multiple longitudinal cavities are employed. The liquid is a suitable liquid safe for oral hygiene such as water.

In the forth embodiment, the bladders of the first embodiment are eliminated by extending the elastomeric field to the underside of the top member. The extension of the elastomeric field is molded with longitudinal cavities that are injected with a gas and sealed prior to sonic welding to the top member. When a force is applied to a bristle region, the gas displaces to other bristle regions, which equalizes the pressure on the surfaces in contact with the bristles. To increase the longitudinal displacement verses the transversal displacement multiple longitudinal cavities are employed. The gas is a suitable gas safe for oral hygiene such as air. The gas is sufficiently compressed to assure close to linear displacements.

The fifth embodiment, the pressure equalizing device is a mechanical equalizer where a thin rigid plastic strip, acting as a flat spring, is bonded/molded to the rear surface of the elastomeric field. The size of this plastic spring is approximately the size of the elastomeric field. In addition, the rigid plastic top member is molded with two rigid, thin ribs on its underside. The ribs extend perpendicularly and are in a transverse direction to the top member. The width of the ribs are approximately the same as the width of the spring attached to the elastomeric field. The lengths of the ribs are long enough (approximately 0.1 inches) to touch the spring attached to the elastomeric field when the top member is sonic welded to the rigid frame (no external pressure on bristles). The ribs are positioned on the top member such that they are equidistant from the center of the strip approximately 25% of the length of the strip. When pressure is applied to the center (longitudinally) of the bristles by a convex surface, the strip on the rear of the tuft field deflects toward the top member at the center and away from the top member at the ends as an equalizing reaction to being restrained by the top member ribs. Conversely, if the bristle surface contacts a concave surface there will be pressure at the ends deflecting the strip toward the top member with an equalizing reaction to defect the center or the strip away from the top member.

BRIEF DESCRIPTION OF THE SEVERAL VIEWS OF THE DRAWINGS

The above mentioned features of the invention will become more clearly understood from the following detailed description of the invention read together with the drawings in which.

DETAILED DESCRIPTION OF THE INVENTION

Figure 1B:
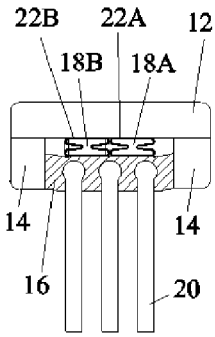
FIG. 1B is a side elevation view in cross section taken along lines 1-1 of FIG. 1A.

The toothbrush of the present invention is designed to conform to teeth surfaces by equalizing bristle pressure longitudinally. Initial bristle pressures are transferred to other bristle regions which push these other bristle regions to the teeth surfaces, thus equalizing bristle pressures. The invention is illustrated generally at 10 in the figures.

In the following description of the invention, elements are identical to each other and denoted with a numeral and the "A" or "B" when referred to specifically. However, when referred to generically, the elements are referred to only the numeral. In the drawings the elements are typically illustrated using the "A" and "B" suffixes. Therefore, when referred to without the "A" or "B" suffixes, it is intended that both of the elements "A" or "B" are being referenced in the appropriate drawings.

Figure 1A:
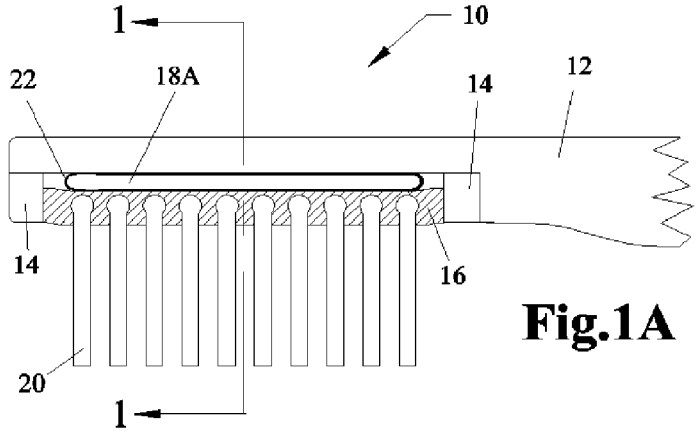
FIG. 1A is a front elevation view in cross section of the toothbrush head using a bladder filled pressure equalizing device without any bristle forces.

FIG. 1A is a longitudinal cross-section of the head 10 with no bristle forces applied by teeth surfaces. FIG. 1B is the cross-section taken along lines 1-1 of FIG. 1A. The bristles 20 are mounted into an elastomeric field 16 using a suitable method such as In-Mold-Tufting (IMT) where bristle 20 tuft ends are formed into a knob base for anchoring in the elastomeric field 16. The elastomeric field 16 is bonded to a rigid perimeter frame 14. The top member 12 is an extension of the toothbrush handle and is bonded to the perimeter frame 14 by sonic welding or other means. A bladder 22 resides between top member 12 and the elastomeric field 16.

Figure 2B:
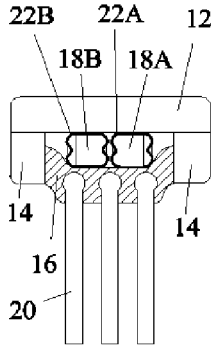
FIG. 2B is a side elevation view in cross section taken along lines 2-2 of FIG. 2A.
Figure 2A:
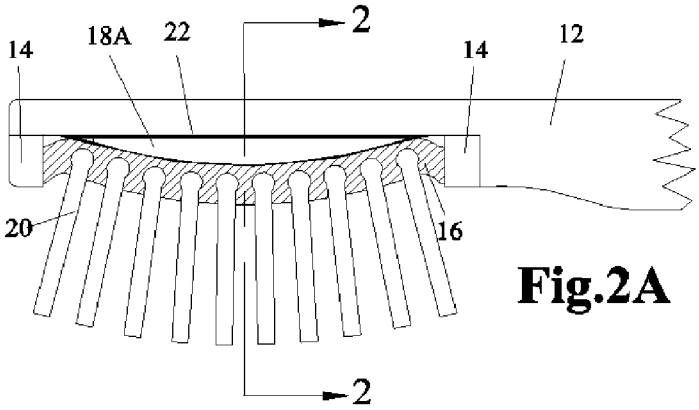
FIG. 2A is a front elevation view in cross section of the toothbrush head using a bladder filled pressure equalizing device with concave bristle forces.
Figure 3B:
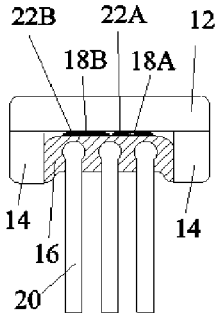
FIG. 3B is a side elevation view in cross section taken along lines 3-3 of FIG. 3A.
Figure 3A:
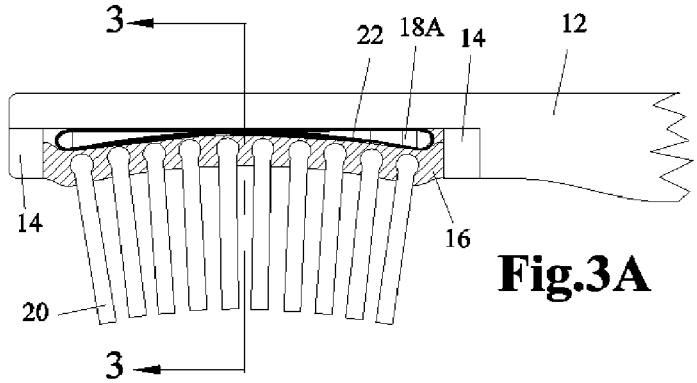
FIG. 3A is a front elevation view in cross section of the toothbrush head using a bladder filled pressure equalizing device with convex bristle forces.

The first embodiment is illustrated by FIG. 1A, FIG. 1B, FIG. 2A, FIG. 2B, FIG. 3A and FIG. 3B. The bladder 22 is filled with a mobile substance 18 which is water or any liquid suitable in the environment of oral hygiene. The toothbrush head 10 of FIG. 1A and FIG. 1B is in a relaxed state where there are no bristle 20 pressures applied. The toothbrush head 10 of FIG. 2A and FIG. 2B has bristle 20 pressures applied by a concave teeth surface. On initial contact with the concave surface there are bristle 20 pressures applied to the longitudinal ends of the elastomeric field 16 and the longitudinal ends of the bladder 22. The bladder 22 narrows at its longitudinal ends and pushes the mobile substance 18 (liquid) toward the center of the bladder 22 which expands the center of the bladder 22 as shown in FIG. 2A and FIG. 2B. This expansion at the center of bladder 22 pushes the center of the elastomeric field 16 and the respective bristles 20 which tends to equalize all bristle 20 pressures. Similarly, FIG. 3A and FIG. 3B show pressure bristle 20 equalization when there is initial contact with a convex surface where bristle 20 pressure is applied to the center of the elastomeric field 16 and to the center of the bladder 22. The narrowing of the bladder 22 center pushes the mobile substance 18 (liquid) to the longitudinal ends of the bladder 22. This expansion of the longitudinal ends of the bladder 22 pushes the longitudinal ends of the elastomeric field 16 and respective bristles 20 which tend to equalize all bristle 20 pressures.

In the above description, the bladder 22 represents two bladders 22A and 22B. Multiple bladders 22A and 22B are placed side-by-side to reduce the mobile substance 18A and 18B (liquid) movement in the transverse direction and maximizing the mobile substance 18A and 18B movement longitudinally. The number of bladders 22 placed side-by-side is not limited to two.

In the first embodiment above, the effectiveness of bristle 20 equalization is directly proportional to the bladder 22 pressures transferred and is maximized by reducing the amount of work required by the elastomeric field 16 and the bladder 22. To reduce the work required by the bladder 22, it should be resilient and not allowed to stretch; it should collapse as shown in FIG. 1B. Similarly the elastomeric field 16 should be resilient, especially the perimeter region between the bristles 20 and the frame 14. The approximate range of the force applied to a toothbrush head 10 is 8 to 24 ounces. The approximate area of the surface of the bristles 20 is 0.5 square inches; i.e., the approximate range of pressure applied to a toothbrush head is 1 to 3 PSI. Therefore, the total pressure required to flex the elastomeric field 16 and the bladder 22 should be much less than 1 to 3 PSI.

The second embodiment is illustrated by FIG. 1A, FIG. 1B, FIG. 2A, FIG. 2B, FIG. 3A and FIG. 3B. The bladder 22 is filled with the substance 18 which is air or any gas suitable in the environment of oral hygiene. The toothbrush head 10 of FIG. 1A and FIG. 1B is in a relaxed state where there are no bristle 20 pressures applied. The toothbrush head 10 of FIG. 2A and FIG. 2B has bristle 20 pressures applied by a concave teeth surface. On initial contact with the concave surface there are bristle 20 pressures applied to the longitudinal ends of the elastomeric field 16 and the longitudinal ends of the bladder 22. The bladder 22 narrows at its longitudinal ends and pushes the mobile substance 18 (gas) toward the center of the bladder 22 which expands the center of the bladder 22 as shown in FIG. 2A and FIG. 2B. This expansion at the center of bladder 22 pushes the center of the elastomeric field 16 and the respective bristles 20 which tends to equalize all bristle 20 pressures. Similarly, FIG. 3A and FIG. 3B show bristle 20 pressure equalization when there is initial contact with a convex surface where bristle 20 pressure is applied to the center of the elastomeric field 16 and to the center of the bladder 22. The narrowing of the bladder 22 center pushes the mobile substance 18 (gas) to the longitudinal ends of the bladder 22. This expansion of the longitudinal ends of the bladder 22 pushes the longitudinal ends of the elastomeric field 16 and respective bristles 20 which tend to equalize all bristle 20 pressures.

In the above description, the bladder 22 represents two bladders 22A and 22B. Multiple bladders 22A and 22B are placed side-by-side to reduce the mobile substance 18A and 18B (gas) movement in the transverse direction and maximizing the mobile substance 18A and 18B movement longitudinally. The number of bladders 22 placed side-by-side is not limited to two.

In the second embodiment above, the effectiveness of bristle 20 equalization is directly proportional to the bladder 22 pressures transferred and is maximized by reducing the amount of work required by the elastomeric field 16 and the bladder 22. To reduce the work required by the bladder 22, the bladder should be resilient and not allowed to stretch; it should collapse as shown in FIG. 1B. Similarly the elastomeric field 16 should be resilient, especially the perimeter region between the bristles 20 and the frame 14. The approximate range of the force applied to a toothbrush head 10 is 8 to 24 ounces. The approximate area of the surface of the bristles 20 is 0.5 square inches; i.e., the approximate range of pressure applied to a toothbrush head is 1 to 3 PSI. Therefore, the total pressure required to flex the elastomeric field 16 and the bladder 22 should be much less than 1 to 3 PSI.

Figure 4B:
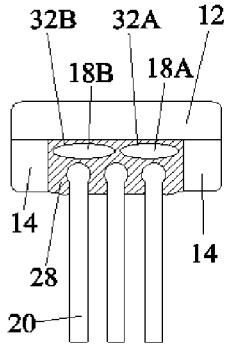
FIG. 4B is a side elevation view in cross section taken along lines 4-4 of FIG. 4A.
Figure 4A:
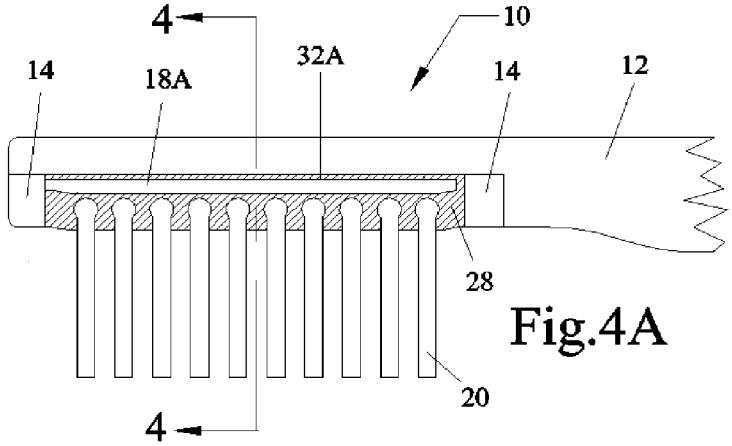
FIG. 4A is a front elevation view in cross section of the toothbrush head using a elastomer channel filled pressure equalizing device without any bristle forces.

FIG. 4A is a longitudinal cross-section of the head 10 with no bristle forces applied by teeth surfaces. FIG. 4B is the cross-section taken along lines 4-4 of FIG. 4A. The bristles 20 are mounted into an elastomeric field 28 using a suitable method such as In-Mold-Tufting (IMT) where bristle 20 tuft ends are formed into a knob base for anchoring in the elastomeric field 28. The elastomeric field 28 is bonded to a rigid perimeter frame 14. The top member 12 is an extension of the toothbrush handle and is bonded to the perimeter frame 14 by sonic welding or other means. The elastomeric field 28 is extended to the top member 12 and two elongated cavities 32 are molded in the elastomeric field 28 replacing the bladders 22 in FIG. 1A. The insertion and sealing of the cavities 32, the bonding of the bristles 20 and frame 14 is done using a multistage molding process.

Figure 5B:
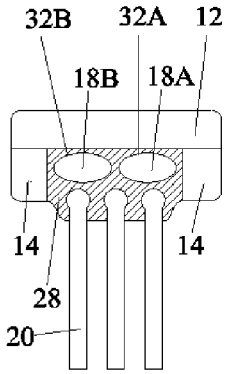
FIG. 5B is a side elevation view in cross section taken along lines 5-5 of FIG. 5A.
Figure 5A:
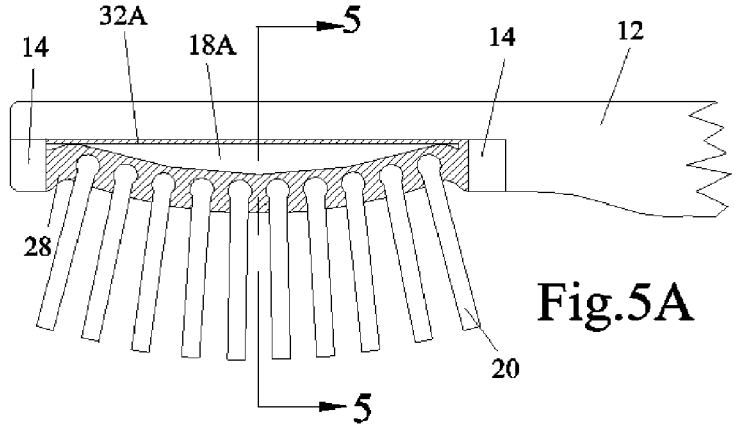
FIG. 5A is a front elevation view in cross section of the toothbrush head using a elastomer channel filled pressure equalizing device with concave bristle forces.
Figure 6B:
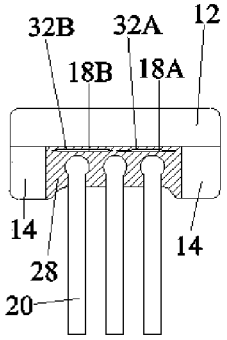
FIG. 6B is a side elevation view in cross section taken along lines 6-6 of FIG. 6A.
Figure 6A:
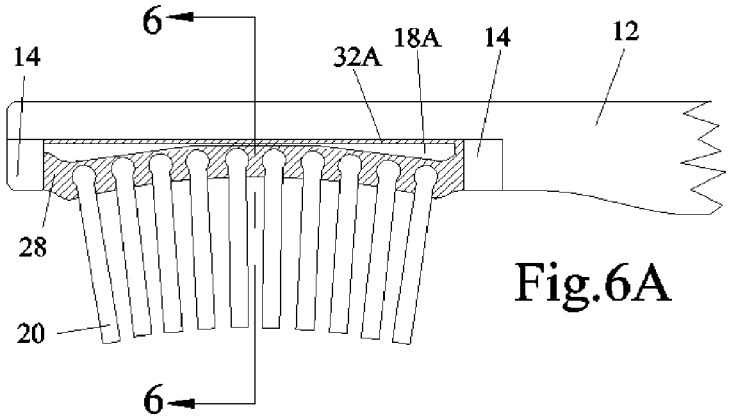
FIG. 6A is a front elevation view in cross section of the toothbrush head using a elastomer filled pressure equalizing device with convex bristle forces.

The third embodiment is illustrated by FIG. 4A, FIG. 4B, FIG. 5A, FIG. 5B, FIG. 6A and FIG. 6B is the same as the first embodiment with the bladder 22 being replaced with a cavity 32 in the elastomeric field 28. The cavity 32 is injected with the substance 18 which is water or any liquid suitable in the environment of oral hygiene. The toothbrush head 10 of FIG. 4A and FIG. 4B is in a relaxed state where there are no bristle 20 pressures applied. The toothbrush head 10 of FIG. 5A and FIG. 5B has bristle 20 pressures applied by a concave teeth surface. On initial contact with the concave surface there are bristle 20 pressures applied to the longitudinal ends of the elastomeric field 28 and the longitudinal ends of the cavity 32. The cavity 32 narrows at its longitudinal ends and pushes the mobile substance 18 (liquid) toward the center of the cavity 32 which expands the center of the cavity 32 as shown in FIG. 5A and FIG. 5B. This expansion at the center of cavity 32 pushes the center of the elastomeric field 28 and the respective bristles 20 which tends to equalize all bristle 20 pressures. Similarly, FIG. 6A and FIG. 6B show bristle 20 pressure equalization when there is initial contact with a convex surface where bristle 20 pressure is applied to the center of the elastomeric field 28 and to the center of the cavity 32. The narrowing of the cavity 32 center pushes the mobile substance 18 (liquid) to the longitudinal ends of the cavity 32. This expansion of the longitudinal ends of the cavity 32 pushes the longitudinal ends of the elastomeric field 28 and respective bristles 20 which tend to equalize all bristle 20 pressures.

In the above description, the cavity 32 represents two cavities 32A and 32B. Multiple cavities 32A and 32B are placed side-by-side to reduce the mobile substance 18A and 18B (liquid) movement in the transverse direction and maximizing the mobile substance 18A and 18B movement longitudinally. The number of cavities 32 placed side-by-side is not limited to two.

In the third embodiment above, the effectiveness of bristle 20 equalization is directly proportional to the cavity 32 pressures transferred and is maximized by reducing the amount of work required by the elastomeric field 28. The elastomeric field 28 should be resilient, especially the perimeter region between the bristles 20 and the frame 14. The approximate range of the force applied to a toothbrush head 10 is 8 to 24 ounces. The approximate area of the surface of the bristles 20 is 0.5 square inches; i.e., the approximate range of pressure applied to a toothbrush head is 1 to 3 PSI. Therefore, the total pressure required to flex the elastomeric field 28 and the cavity 32 should be much less than 1 to 3 PSI.

The forth embodiment is illustrated by FIG. 4A, FIG. 4B, FIG. 5A, FIG. 5B, FIG. 6A and FIG. 6B. The cavity 32 is injected with the substance 18 which is air or any gas suitable in the environment of oral hygiene. The toothbrush head 10 of FIG. 4A and FIG. 4B is in a relaxed state where there are no bristle 20 pressures applied. The toothbrush head 10 of FIG. 5A and FIG. 5B has bristle 20 pressures applied by a concave teeth surface. On initial contact with the concave surface there are bristle 20 pressures applied to the longitudinal ends of the elastomeric field 28 and the longitudinal ends of the cavity 32. The cavity 32 narrows at its longitudinal ends and pushes the mobile substance 18 (gas) toward the center of the cavity 32 which expands the center of the cavity 32 as shown in FIG. 5A 10 and FIG. 5B. This expansion at the center of cavity 32 pushes the center of the elastomeric field 28 and the respective bristles 20 which tends to equalize all bristle 20 pressures. Similarly, FIG. 6A and FIG. 6B show bristle 20 pressure equalization when there is initial contact with a convex surface where bristle 20 pressure is applied to the center of the elastomeric field 28 and to the center of the cavity 32. The narrowing of the cavity 32 center pushes the mobile substance 18 (gas) to the longitudinal ends of the cavity 32. This expansion of the longitudinal ends of the cavity 32 pushes the longitudinal ends of the elastomeric field 28 and respective bristles 20 which tend to equalize all bristle 20 pressures.

In the above description, the cavity 32 represents two cavities 32A and 32B. Multiple cavities 32A and 32B are placed side-by-side to reduce the mobile substance 18A and 18B (gas) movement in the transverse direction and maximizing the mobile substance 18A and 18B movement longitudinally. The number of cavities 32 placed side-by-side is not limited to two.

In the forth embodiment above, the effectiveness of bristle 20 equalization is directly proportional to the cavity 32 pressures transferred and is maximized by reducing the amount of work required by the elastomeric field 28. The elastomeric field 28 should be resilient, especially the perimeter region between the bristles 20 and the frame 14. The approximate range of the force applied to a toothbrush head 10 is 8 to 24 ounces. The approximate area of the surface of the bristles 20 is 0.5 square inches; i.e., the approximate range of pressure applied to a toothbrush head is 1 to 3 PSI. Therefore, the total pressure required to flex the elastomeric field 28 and the cavity 32 should be much less than 1 to 3 PSI.

Figure 7B:
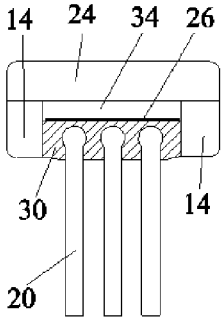
FIG. 7B is a side elevation view in cross section taken along lines 7-7 of FIG. 7A.
Figure 7A:
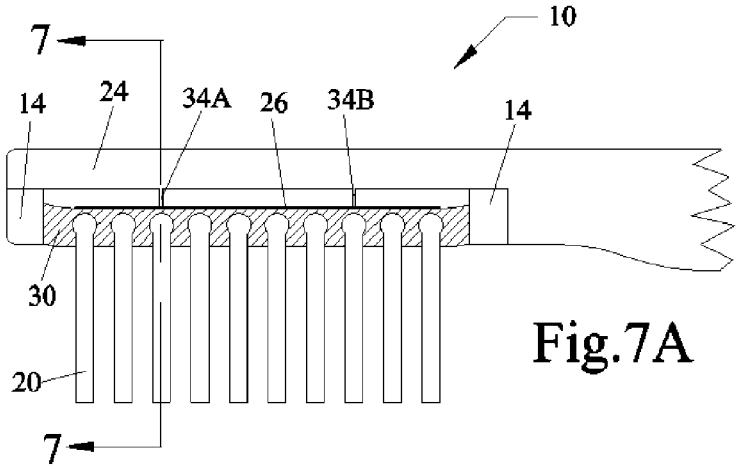
FIG. 7A is a front elevation view in cross section of the toothbrush head using a flat plastic spring pressure equalizing device without any bristle forces.
Figure 8B:
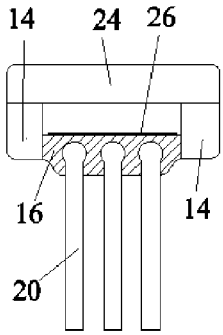
FIG. 8B is a side elevation view in cross section taken along lines 8-8 of FIG. 8A.
Figure 8A:
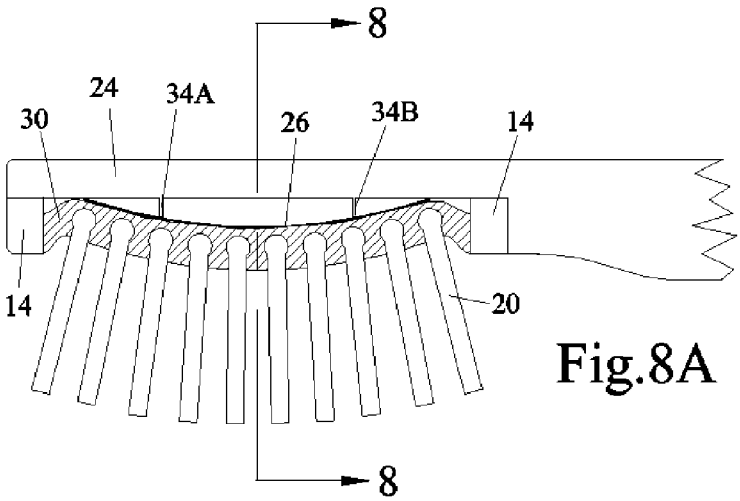
FIG. 8A is a front elevation view in cross section of the toothbrush head using a flat plastic spring pressure equalizing device with concave bristle forces.
Figure 9B:
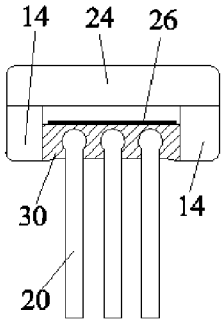
FIG. 9B is a side elevation view in cross section taken along lines 9-9 of FIG. 9A.
Figure 9A:
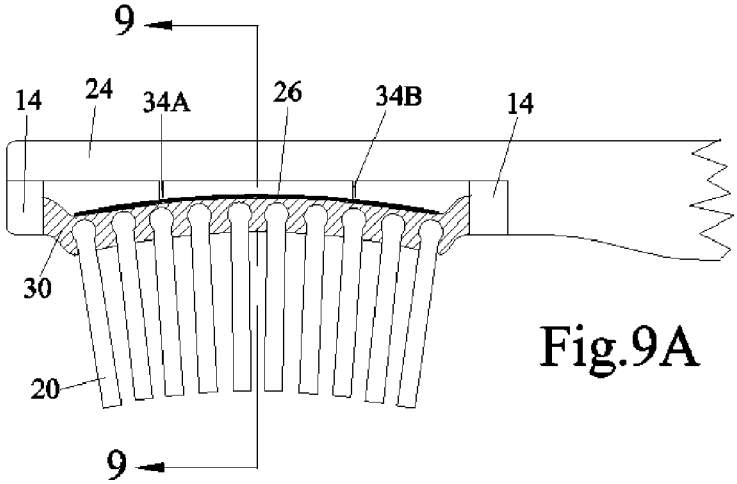
FIG. 9A is a front elevation view in cross section of the toothbrush head using a flat plastic spring pressure equalizing device with convex bristle forces.

The fifth embodiment is illustrated by FIG. 7A, FIG. 7B, FIG. 8A, FIG. 8B, FIG. 9A and FIG. 9B. The bristles 20 are mounted into an elastomeric field 30 using a suitable method such as In-Mold-Tufting (IMT) where bristle 20 tuft ends are formed into a knob base for anchoring in the elastomeric field 30. The elastomeric field 30 is bonded to a rigid perimeter frame 14. The top member 12 is an extension of the toothbrush handle and is bonded to the perimeter frame 14 by sonic welding or other means. The spring 26 is of rigid plastic, or other material, is bonded to the elastomeric field 30. The spring 26 has similar properties as spring steel where it has little deflection memory until it exceeds its elastic limit. The top member 24 differs from other embodiments in that it has additional transversal ribs 34. The ribs 34 are part of the top member mold, they are the full transversal width of the elastomeric field 30, very narrow and rounded at the edge that is in contact with the spring 26. The ribs 34 are positioned approximately 25% of the 10 length of the flat spring 26 from each end of spring 26. The toothbrush head 10 of FIG. 7A and FIG. 7B is in a relaxed state where there are no bristle 20 pressures applied. The toothbrush head 10 of FIG. 8A and FIG. 8B has bristle 20 pressures applied by a concave teeth surface. On initial contact with the concave surface there are bristle 20 pressures applied to the longitudinal ends of the elastomeric field 30 and the longitudinal ends of the spring 26. This pressure deflects both longitudinal ends of the spring 26 toward the top member 24 forcing the center of the spring 26 to bellow away from the top member 24 since the spring 26 is restrained by the ribs 34 as shown in FIG. 8A and FIG. 8B. This defection at the longitudinal center of spring 26 pushes the center of the elastomeric field 30 and the respective bristles 20 which tends to equalize all bristle 20 pressures. Similarly, FIG. 9A and FIG. 9B show bristle 20 equalization when there is initial bristle 20 contact with a convex surface. When bristle 20 pressure is applied to the center of the elastomeric field 30 and to the center of the spring 26 the spring 26 longitudinal ends are forced away from the top member since the spring 26 is restrained by ribs 34. This deflection at the longitudinal ends of the spring 26 pushes the longitudinal ends of the elastomeric field 30 and respective bristles 20 which tend to equalize all bristle 20 pressures.

In the fifth embodiment above, the effectiveness of bristle 20 equalization is maximized by reducing the amount of work required by the elastomeric field 30 and the spring 26. To reduce the work required by the elastomeric field 30, it should be resilient, especially the perimeter region between the bristles 20 and the frame 14. Without compromising the necessary spring-like characteristics of spring 26, the work necessary to deflect it should be minimized. The approximate range of the force applied to a toothbrush head 10 is 8 to 24 ounces. The approximate area of the surface of the bristles 20 is 0.5 square inch; i.e., the approximate range of pressure applied to a toothbrush head is 1 to 3 PSI. Therefore, the total pressure required to flex the elastomeric field 30 and the spring 26 should be much less than 1 to 3 PSI.

From the forgoing description, it will be recognized by those skilled in the art that a toothbrush head conforms to the convex and concave surfaces by the equalizing bristle pressures; that bristle pressures literally transfer from initial bristle contact regions and are applied to other bristle regions.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A toothbrush, comprising:

a) an elongated handle having a rigid top member extending from an end thereof;

b) a rigid plastic perimeter frame, said frame defining an opening extending through a central portion thereof, said frame bonded to a surface of the top member;

c) an elastomeric field material within the opening of the frame and bonded to an inner surface thereof, the elastomeric field material including a first surface facing the top member and an opposite second surface, the second surface of the elastomeric field material having a plurality of bristles fixed to and extending therefrom, the first surface of the elastomeric field material being spaced from the top member in a rest position to define a void space there between;

d) a longitudinal pressure equalizer disposed in the void space between the elastomeric field material and the top member; and e) whereby the bristles readily conform to both convex and concave surfaces by equalizing bristle pressure.

2. The toothbrush of claim 1, wherein the pressure equalizer comprises at least one resilient bladder filled with a pressure equalizing substance.

3. The toothbrush of claim 2, wherein the pressure equalizing substance is a fluid.

4. The toothbrush of claim 2, wherein the pressure equalizing substance is a gas.

5. The toothbrush of claim 1, wherein the pressure equalizer comprises a flat spring.

* * * * *